US006362575B1

(12) United States Patent
Chang et al.

(10) Patent No.: US 6,362,575 B1
(45) Date of Patent: Mar. 26, 2002

(54) VOLTAGE REGULATED ELECTRONIC BALLAST FOR MULTIPLE DISCHARGE LAMPS

(75) Inventors: Chin Chang, Yorktown Heights, NY (US); Theo Stommen, Veldhoven (NL)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/713,867

(22) Filed: Nov. 16, 2000

(51) Int. Cl.[7] ..... H05B 37/02

(52) U.S. Cl. ..... 315/224; 315/291; 315/307; 315/244; 315/312; 315/209 R; 315/DIG. 7

(58) Field of Search ..... 315/312, 325, 315/209 R, 219, 224, 225, 247, 276, 291, 307, DIG. 7; 363/17, 98

(56) References Cited

U.S. PATENT DOCUMENTS 4,585,974 A * 4/1986 Stupp et al. ..... 315/307
5,073,745 A 12/1991 Kakitani ..... 315/307
5,615,093 A 3/1997 Nalbant ..... 363/25
5,696,431 A 12/1997 Giannopoulos et al. ..... 315/308
5,781,418 A 7/1998 Chang et al. ..... 363/16
5,838,116 A * 11/1998 Katyl et al. ..... 315/307
5,874,809 A * 2/1999 Hagen ..... 315/224
6,016,257 A * 1/2000 Chang et al. ..... 363/17
6,181,079 B1 * 1/2001 Chang et al. ..... 315/247

FOREIGN PATENT DOCUMENTS

JP 5283183 A 10/1993
JP 6251882 A 9/1994
WO 9908373 A2 2/1999

* cited by examiner

*Primary Examiner*—Haissa Philogene
(74) *Attorney, Agent, or Firm*—Dicran Halajian

(57) ABSTRACT

A method and apparatus for regulating the lamp output voltage in a multiple (parallel) discharge lamp fixture irrespective of the number of operating lamps and based upon monitoring of the lamp filament current. A modification thereof provides constant and equal currents in the discharge lamps irrespective of the number of operating lamps.

19 Claims, 5 Drawing Sheets

VOLTAGE REGULATED ELECTRONIC BALLAST FOR MULTIPLE DISCHARGE LAMPS

BACKGROUND OF THE INVENTION

This invention relates to an electronic ballast apparatus for the ignition and operation of a plurality of gas discharge lamps, and more particularly to an improved high frequency electronic ballast for multiple discharge lamps which regulates the output voltage supplied to the discharge lamps despite the absence or inoperation of one or more of the discharge lamps of a bank of parallel connected lamps. The invention further relates to a method of igniting and operating multiple discharge lamps with a regulated lamp output voltage, i.e. multiple lamp independent lamp operation (ILO).

One form of high frequency electronic ballast for the operation of multiple gas discharge lamps is described in the copending U.S. application Ser. No. 09/467,596 filed Dec. 20, 1999 in the name of Chang et al, issued on Jan. 30, 2001 as U. S. Pat. No. 6,181,079 B1, and which is shown in the accompanying FIG. 1 of the drawings. This electronic ballast circuit basically consists of two building blocks. The front end is a boost converter for power factor correction and universal input line voltage regulation. The main components are a transistor power switch Q1, an inductor L1, a diode D5 and the DC storage capacitor C1 along with an EMI filter and the diode bridge rectifier interposed between the AC supply voltage (e.g. 60 Hz) and the boost converter. The transistor switch Q1 is periodically switched on and off by a control circuit 7 as a function of the voltage across capacitor C1 and the current flowing through the transistor switch Q1 and a series connected sensing resistor 6.

The back end is a typical voltage-fed half-bridge inverter loaded with a group of parallel connected discharge lamps via a resonant tank circuit L2-C3. The main components are the power switches Q2 and Q3, resonant components including capacitor C3, inductor L2 and possibly the magnetizing inductance of the output transformer T1. The capacitors Clp in the secondary circuit of the transformer T1 are usually provided in order to ballast the lamp current and to protect against possible lamp rectification at the end of lamp life. The operation of the power switches Q2 and Q3 is controlled by a high voltage control IC 11 as a function of current flow in the transistor switch Q3 and of the voltage on capacitor C3.

In order to achieve multiple lamp independent operation (ILO) in a circuit such as that shown in FIG. 1, the output voltage (Vo) applied across the multiple parallel connected discharge lamps is usually kept constant at an rms value that exceeds the ignition voltage of the loaded gas discharge lamps. The level of the lamp ignition voltage is higher than the lamp operating voltage and presents the hazard of electric shock in the case where one or more of the multiple discharge lamps is (are) absent from a multiple lamp fixture.

For example, in the case of a fixture supporting multiple fluorescent TL lamps such as those with the manufacturers designation F32T8/TL735, the reliable ignition voltage is about 550 V (rms). In order to achieve independent lamp operation (ILO), the output (lamp) voltage is usually regulated to about 550 V in the normal steady state operation mode of the lamps even when less than all of the discharge lamps are operating, i.e. in a four-lamp fixture, even if one, two or three of the lamps are inoperative or are removed from the lamp fixture, the output voltage is still regulated at the ignition voltage value of 550 V (rms). In this case, the open circuit voltage across the lamp connector terminals will be the ignition voltage, 550 V (rms) which is required for the ignition of a newly inserted lamp or lamps. This presents the electric shock hazard mentioned above, especially during the removal of a discharge lamp or the insertion of a new lamp in the lamp fixture.

This problem is further exacerbated in Europe where the IEC 928 safety requirement, e.g. Section 12 concerning protection against electric shock, states that "For ballasts whose output terminals are to be connected to 250 V rated components, the voltage between any output terminals and between any output terminal and neutral or earth shall decrease within 5s after switching on or beginning of the starting process to a value less than 700 V (peak), under both normal and abnormal conditions . . .". This 700 V peak value translates to 495 V (rms) for sinusoidal waveforms. Therefore, the steady state output voltage exceeds the open circuit safety voltage. A ballast that operates with a 550 V (rms) lamp output voltage during steady state operation would clearly violate the European electric shock safety requirements of IEC 928.

Attention is also directed to the Japanese abstract 5-283183 by the Toshiba Corp. for a Discharge Lamp Lighting Device and Lighting System. This abstract describes a multiple lamp apparatus which detects if one lamp is removed from a bank of two parallel lamps by the use of a voltage detection circuit and a lamp filament detection circuit. This is but one of several known schemes for lamp insertion/removal detection based upon the detection of filament current. Most of these prior art circuits provide circuit protection when a lamp is removed by turning off the electronic ballast or putting the ballast into a standby mode. It appears that JP-A5-283,183 falls into this category of ballasts because of the use of the AND logic gate circuit 30. This circuit is not applicable for determining the number of inoperative lamps in a multiple lamp apparatus.

SUMMARY OF THE INVENTION

It is therefore an object of the invention to provide a high frequency electronic ballast for operation of multiple discharge lamps with a regulated lamp output voltage irrespective of the number of lamps actually in operation (ILO).

It is another object of the invention to provide a high frequency electronic ballast for operation of multiple discharge lamps which simultaneously provides independent lamp operation while satisfying the electric shock safety requirements that are desirable in this type of apparatus.

Another object of the invention is to provide an electronic ballast of the type mentioned which also regulates, e.g. makes constant, the lamp current in the case where the number of operating lamps is variable, thereby extending the useful lamp life and improving the ballast efficacy for partial load conditions.

A still further object of the invention is an electronic ballast of simple and inexpensive construction that nevertheless makes possible the objects and advantages mentioned above.

Another object of the invention is to provide an improved method of operating multiple gas discharge lamps which achieves the objects of the invention described above.

The above and other objects and advantages are achieved in accordance with the present invention by independently operating a plurality of discharge lamps in parallel by means of a high frequency electronic ballast that regulates the output lamp voltage even if one or more of the total number of lamps is inoperative or is removed from its connection terminals.

The regulation of lamp output voltage is achieved by monitoring and detecting the level of total lamp filament current flowing in the circuit, which then provides an indication of the actual number of discharge lamps that are in operation. A reference voltage is generated that is determined by the level of the detected total lamp filament current. By means of a feedback loop, the lamp output voltage is compared with the generated reference voltage and the frequency of the lamp output voltage is automatically adjusted so as to maintain a fixed (constant) output voltage level irrespective of the number of discharge lamps in operation at any given moment in time.

When a discharge lamp is inserted into a fixture that holds the multiple lamp configuration, there will be a rise or jump in the total filament current which is sensed. A short higher reference voltage is generated and the feedback loop responds to momentarily generate a higher lamp output voltage at a voltage level sufficient to promote ignition of the inserted discharge lamp. This higher output voltage is generated for a short time duration that will ensure lamp ignition, for example, for a time period much less than 5 seconds e.g., 100 ms. After lamp ignition, the apparatus then automatically readjusts the output lamp voltage back to the fixed (constant) voltage level suitable for steady state operation of the multiple parallel connected discharge lamps.

In the event a discharge lamp is removed from the lamp fixture, the electronic ballast maintains the generated reference voltage at the same level (unchanged) as before and the lamp output voltage is maintained at a constant voltage level. In one variation of this scheme the generated reference voltage is momentarily reduced to a lower voltage level which results in a faster output voltage regulation by the circuit during the lamp removal operation.

It is also desirable to maintain the discharge lamp current constant irrespective of the number of lamps actually operating in a multiple lamp fixture at any given moment in time. Therefore, in another preferred embodiment of the invention, a reference voltage generation scheme is provided to prevent overdrive of the remaining lamps after one or more lamps in a lamp fixture become inoperative or are removed and not replaced immediately. In this embodiment of the invention, the steady state lamp output voltage varies dependent upon the actual number of discharge lamps that are in operation in the multiple lamp fixture. Dependent upon the actual number of operating lamps, the operating frequency of the electronic ballast circuit is automatically adjusted so that the steady state lamp output voltage is of a value such that the current in each operating lamp is fixed at its optimum operational value irrespective of the number of actual lamps in operation. Thus, dependent upon the number of operating lamps, a different circuit operating frequency is adjusted so that the steady state lamp voltage is adjusted in a manner whereby each lamp current is almost the same in accordance with the adjusted circuit operating frequency. Thus, there is a distinct operating frequency for each combination of operating discharge lamps.

Accordingly, it is another object of the invention to provide a high frequency electronic ballast circuit which provides almost constant lamp current irrespective of the number of operational lamps in a multiple lamp apparatus.

The foregoing and other objects, features and advantages of the invention will become apparent with reference to the following detailed description thereof in connection with the accompanying drawings.

DESCRIPTION OF THE PREFERRED EMBODIMENTS

Corresponding elements in the different figures of the drawings will be identified by providing same with the same reference labels.

Figure 1:
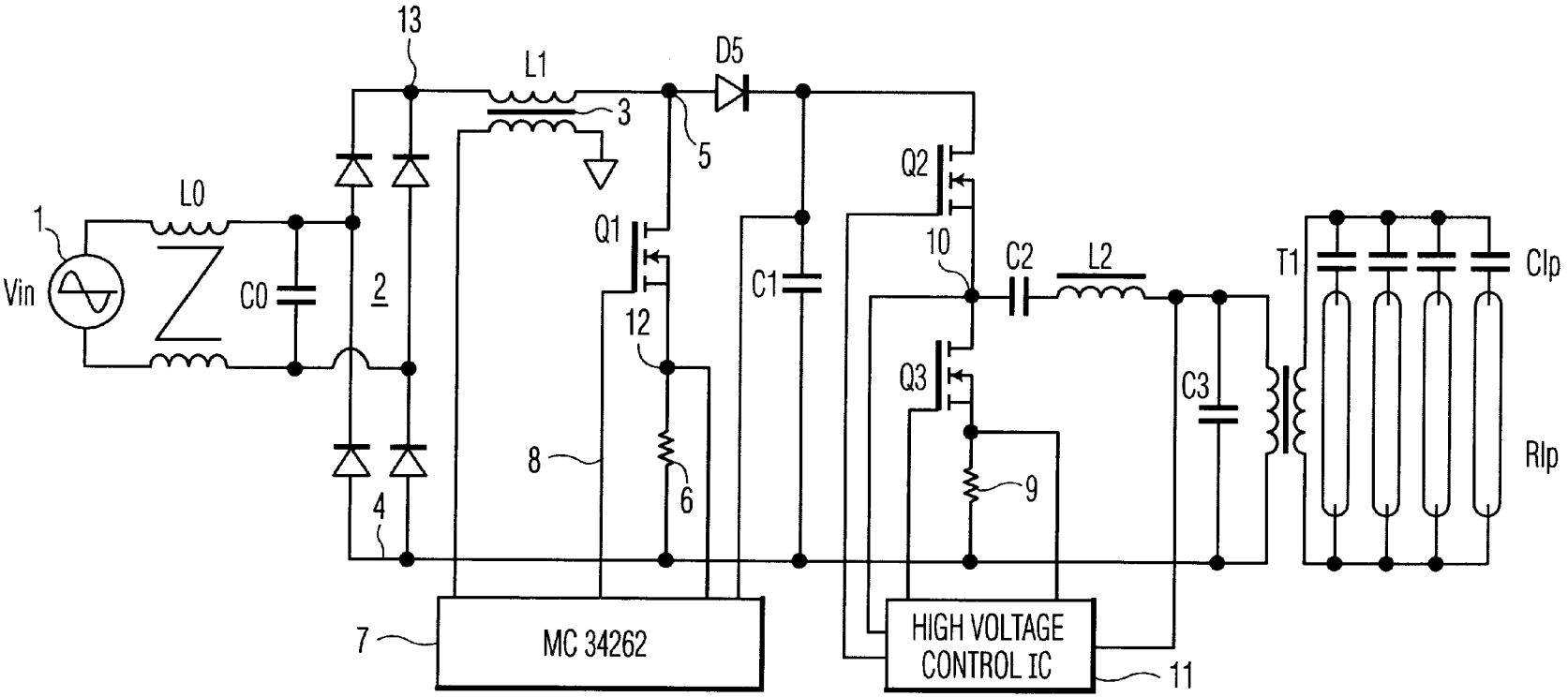
FIG. 1 PRIOR ART
FIG. 1 is a schematic diagram showing the general circuit structure of a prior art high frequency electronic ballast circuit.

FIG. 1 illustrates a general prior art high frequency electronic ballast circuit for operating a plurality of gas discharge lamps Rlp. A 50 or 60 Hz source of AC supply voltage 1 is connected to the input of an EMI filter consisting of a pair of magnetically coupled inductors LO and a capacitor CO. The output of the EMI filter is connected to a pair of input terminals of a 4-diode full wave bridge rectifier 2. A first DC output terminal 13 of the bridge rectifier circuit is connected to one terminal of a boost inductor L1 which is part of a transformer 3. The second bridge rectifier output terminal is connected to a common line 4. The other terminal of inductor L1 is connected to a common junction point 5 between a diode D5 and a transistor power switch Q1.

A current sensing resistor 6 is connected in series circuit with the transistor power switch Q1 to the common line 4. The junction point 12 of transistor switch Q1 and the sensing resistor 6 is connected as a first control input to a control circuit 7, for example an integrated circuit manufactured by Motorola Corporation and designated MC34262. This control circuit is described in a technical data publication by Motorola Corp. published in 1993. The control circuit 7 has an output line 8 that controls the on/off switching of transistor switch Q1.

The diode D5 is connected in series circuit with a storage capacitor C1 across the series circuit consisting of transistor power switch Q1 and sensing resistor 6. An output stage is provided with a half bridge inverter including transistor power switches Q2 and Q3 connected in series circuit with a further current sensing resistor 9 across the storage capacitor C1. Alternately, current sensing resistor 9 could be connected in the common line 4 between the circuit points where MOSFET Q3 and capacitor C3 connect to common line 4. A blocking capacitor C2 and a resonant inductor L2 are connected in series between a junction point 10 between transistor switches Q2 and Q3 and a terminal of the primary winding of an output isolation transformer T1. The other terminal of the transformer primary winding is connected to the common line 4. A resonant capacitor C3 is connected in parallel with the output transformer primary winding.

A control input line is coupled to a junction point between resonant inductor L2, resonant capacitor C3 and the upper terminal of the primary winding and to a first control input terminal of a second control circuit 11 which has two output control lines coupled to respective control electrodes of switching transistors Q2 and Q3. A second control line couples the voltage developed across sensing resistor 9 to a second control input of the high voltage circuit 11, for example, the integrated circuit UBA2010. A third control line connects the junction point 10 to a third input of the control circuit 11. A high voltage control IC suitable for use as the control circuit 11 is described in UBA2010 specification sheet by Philips Corp.

The secondary winding of output transformer T1 is connected to a bank of four parallel connected discharge lamps Rlp via four respective series connected ballast capacitors Clp.

The transistor switch Q1 is periodically turned on and off by control signals delivered to its control electrode from control circuit 7 via the output control line 8. The control circuit 7 switches under the control of signals supplied by the secondary winding of boost inductor L1, the voltage on storage capacitor C1 and a signal determined by the current flow through transistor switch Q1. The input to the front end boost converter is a full wave rectified sinusoidal input line voltage at 50 Hz or 60 Hz. When the power switch Q1 is off the diode D5 is turned on and carries a current for storage capacitor C1 based upon the electromagnetic energy stored in the boost inductor L1. The voltage stored on capacitor C1 provides the operating voltage for the voltage fed half-bridge inverter including power switches Q2 and Q3. Inductor L2 and capacitor C3 form a resonant circuit at the switching frequency of the half-bridge inverter. The operation of this high frequency electronic ballast circuit is well-known and will therefore not be described in further detail.

Figure 2:
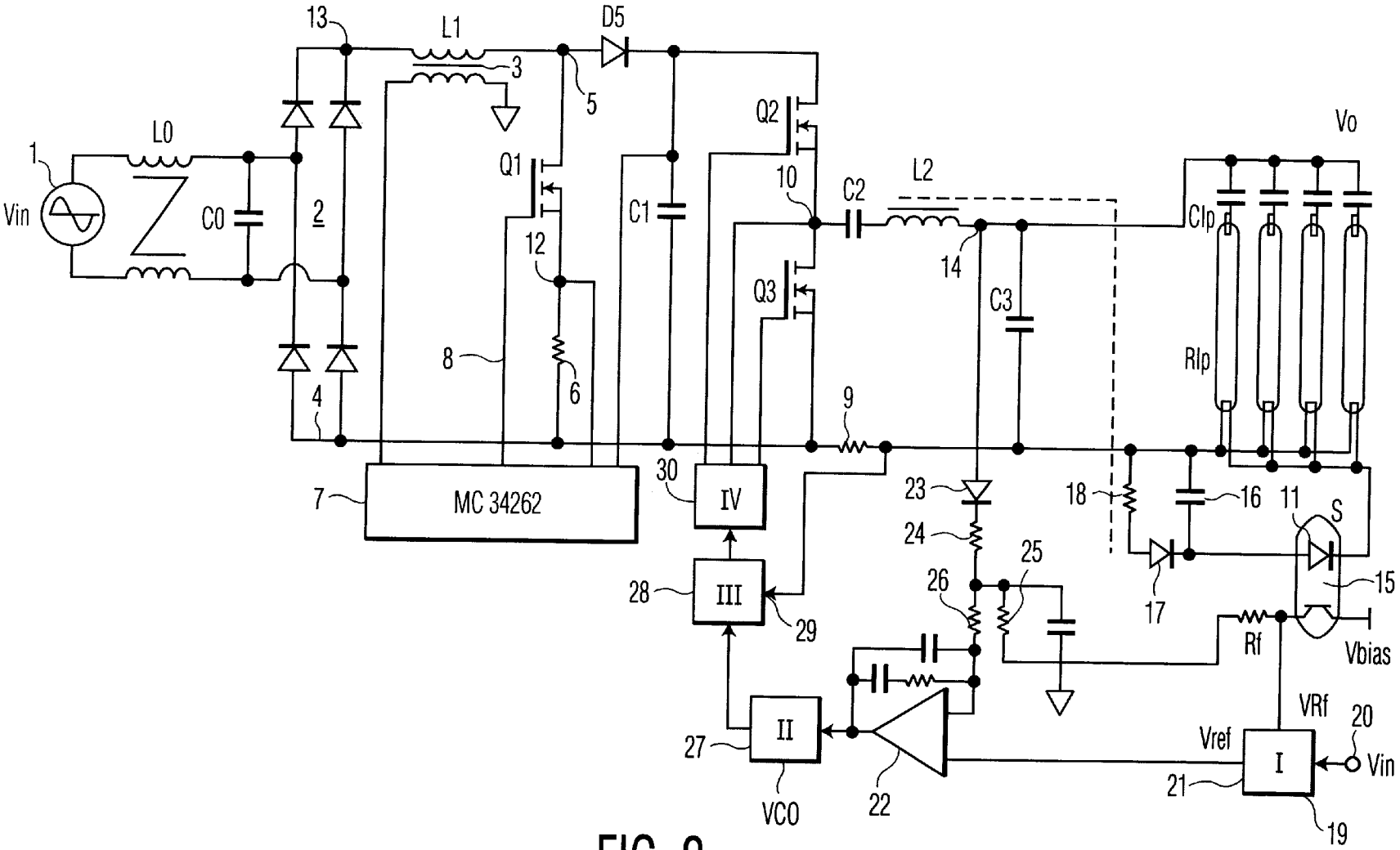
FIG. 2 is a block-schematic circuit diagram of a preferred embodiment of the invention.

A preferred embodiment of the invention is shown in FIG. 2. A low frequency source of AC supply voltage 1, e.g. 50 Hz or 60 Hz, is connected to the input of an EMI filter consisting of a pair of magnetically coupled inductors LO and a capacitor CO. The output of the EMI filter is connected to a pair of input terminals of a 4 diode full wave bridge rectifier 2.

A first DC output terminal 13 of the bridge rectifier is connected to one terminal of a boost inductor L1 which is part of a transformer 3. The second bridge rectifier output terminal is connected to a common line 4. The other terminal of inductor L1 is connected to a common junction point 5 between a diode D5 and a transistor power switch Q1.

A current sensing resistor 6 is connected in series circuit with the transistor power switch Q1 to the common line 4. The junction point 12 of transistor switch Q1 and the sensing resistor 6 is connected as a first control input to a control circuit 7, for example an integrated circuit manufactured by Motorola Corporation and designated MC34262. This control circuit is the same as that depicted in FIG. 1. The control circuit has an output line 8 connected to the gate electrode of the transistor switch Q1 which controls the on/off switching of the transistor switch.

The diode D5 is connected in series circuit with a storage capacitor C1 across the series circuit of transistor power switch Q1 and sensing resistor 6. An output stage is provided which includes a half-bridge inverter including transistor power switches Q2 and Q3 connected in series circuit with a further current sensing resistor 9 across the storage capacitor C1. A blocking capacitor C2 and a resonant inductor L2 are connected in series between a junction point 10 between transistor switches Q2 and Q3 and a junction point 14 of the resonant inductor L2 and one terminal of a resonant capacitor C3. The other terminal of resonant capacitor C3 is connected to the common line 4. The inductor L2 and the capacitor C3 form a resonant circuit. A current sensing resistor 9 is connected in the common line 4 and provides a control voltage for zero voltage switching of transistors Q2 and Q3.

The node 14 is connected to a bank of four parallel connected discharge lamps Rlp via four respective series connected ballast capacitors Clp. The lower filaments of the discharge lamps are all connected to the common line 4 via the current sensing resistor 9 and to one terminal of a total lamp current sensor S consisting of a light emitting diode 11 and an optically coupled photo-sensitive transistor 15, more particularly to one terminal of the LED 11. The other terminal of the LED 11 is connected to a bias voltage supply circuit including a capacitor 16, a diode 17 and a winding 18 magnetically coupled to the resonant inductor L2, as indicated by the dashed line coupling these two windings. The winding 18 and diode 17 are connected in series circuit between the common line 4 and the other terminal of LED 11. The capacitor 16 is connected across this series circuit 17, 18. The bias voltage supply circuit 16–18 provides an almost fixed bias voltage at the other terminal of the light emitting diode 11.

The photo-sensitive transistor 15, which is optically coupled to the LED 11, has one end terminal connected to ground and its other end terminal connected to a junction of reference resistor Rf and one input line of a reference voltage generator 19. The photo-sensitive transistor supplies a voltage VRf to the control circuit 19 that is a function of the total lamp filament current and hence of the number of lamps in operation at any moment in time. A second input of reference voltage generator 19 is connected to a terminal 20 that receives a voltage Vin that determines the limit of a reference voltage, Vref, at the output of the reference voltage generator 19.

Output terminal 21 of the reference voltage generator 19 supplies a reference voltage, $V_{ref}$, to a first input of a compensator/controller circuit 22, which comprises an op-amp and an RC feedback circuit. The level of the reference voltage, $V_{ref}$, is determined by the number of operating discharge lamps present in a lamp fixture at any given moment in time. At the same time, the lamp output voltage appearing at the circuit node between the resonant inductor L2 and the resonant capacitor C3 is applied to a second input of the compensator/controller circuit 22 via a voltage divider consisting of a diode 23, a first resistor 24, a second resistor 25 and a third resistor 26. The diode 23, the resistor 24 and the resistor 26 are serially connected between the circuit output node 14 and the second input of the compensator/controller 22. The resistor 25 is connected at one end to a junction point on the voltage divider between resistors 24 and 26 and at its other end to ground. The voltage at the circuit point 14 is thus scaled down to the voltage level of the reference voltage supplied to the first input of the circuit 22 from the output of the reference voltage generator 19. After processing in the circuit 22, a control voltage at the output of this circuit is supplied to an input of a voltage controlled oscillator (VCO) 27.

The frequency controlled (adjusted) output voltage of the VCO 27 is supplied to an input terminal of a phase detector/control logic circuit 28. A second input 29 of the circuit 28 is connected to the current sensing resistor 9. The output of the circuit 28 is connected to an input of a transistor drive circuit 30, for example a circuit manufactured by International Rectifier with the designation IR2111. The drive circuit 30 supplies 180° out of phase drive voltages to the respective gate electrodes of the field effect transistors Q2 and Q3 so as to drive these transistors alternately into conduction and cut-off. The circuit node 10 between field effect transistors Q2 and Q3 is connected to the drive circuit 30.

Figure 3:
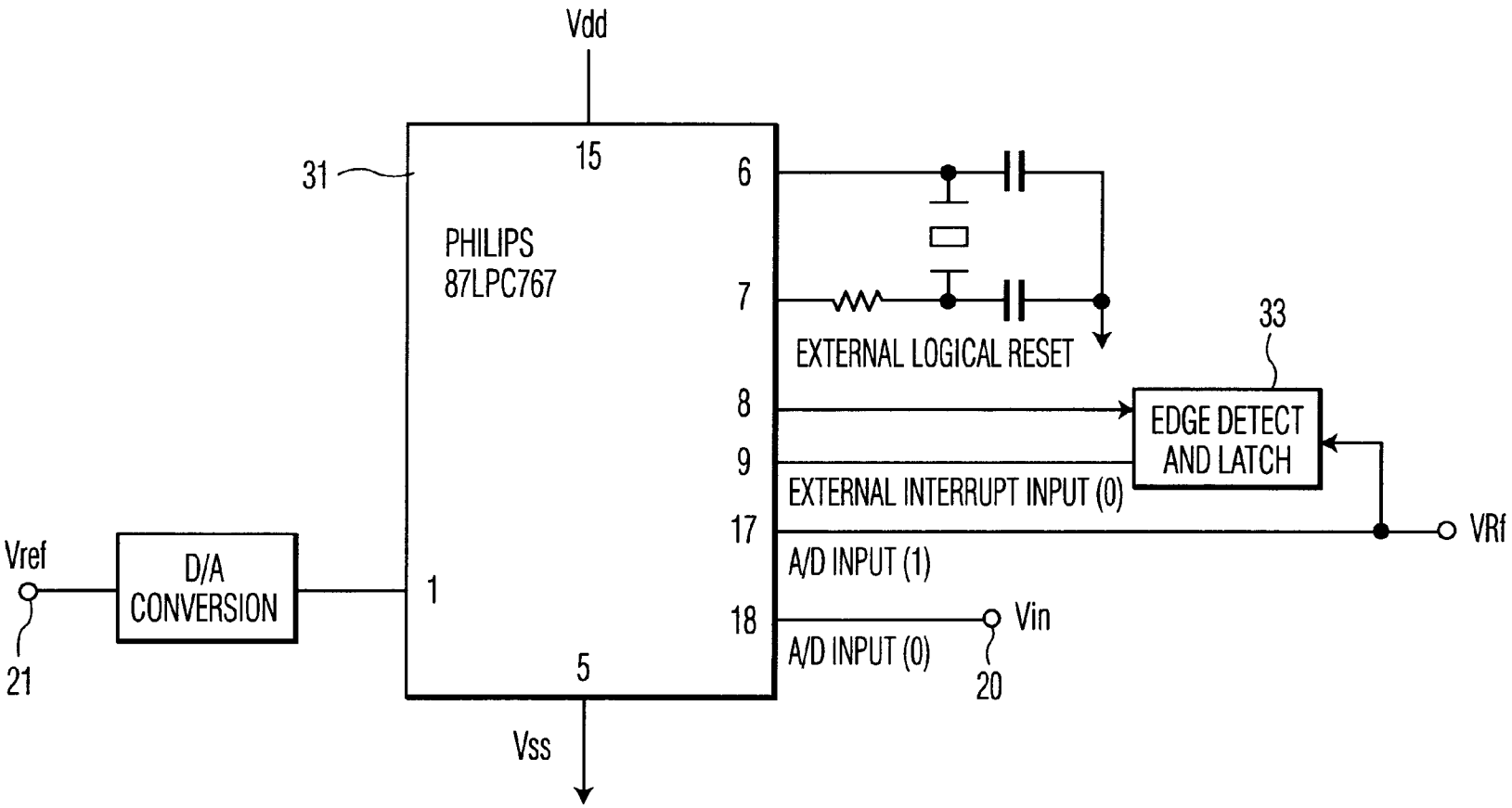
FIG. 3 is a diagram showing a microcontroller based version of the control circuit 19 of FIG. 2.
Figure 5:
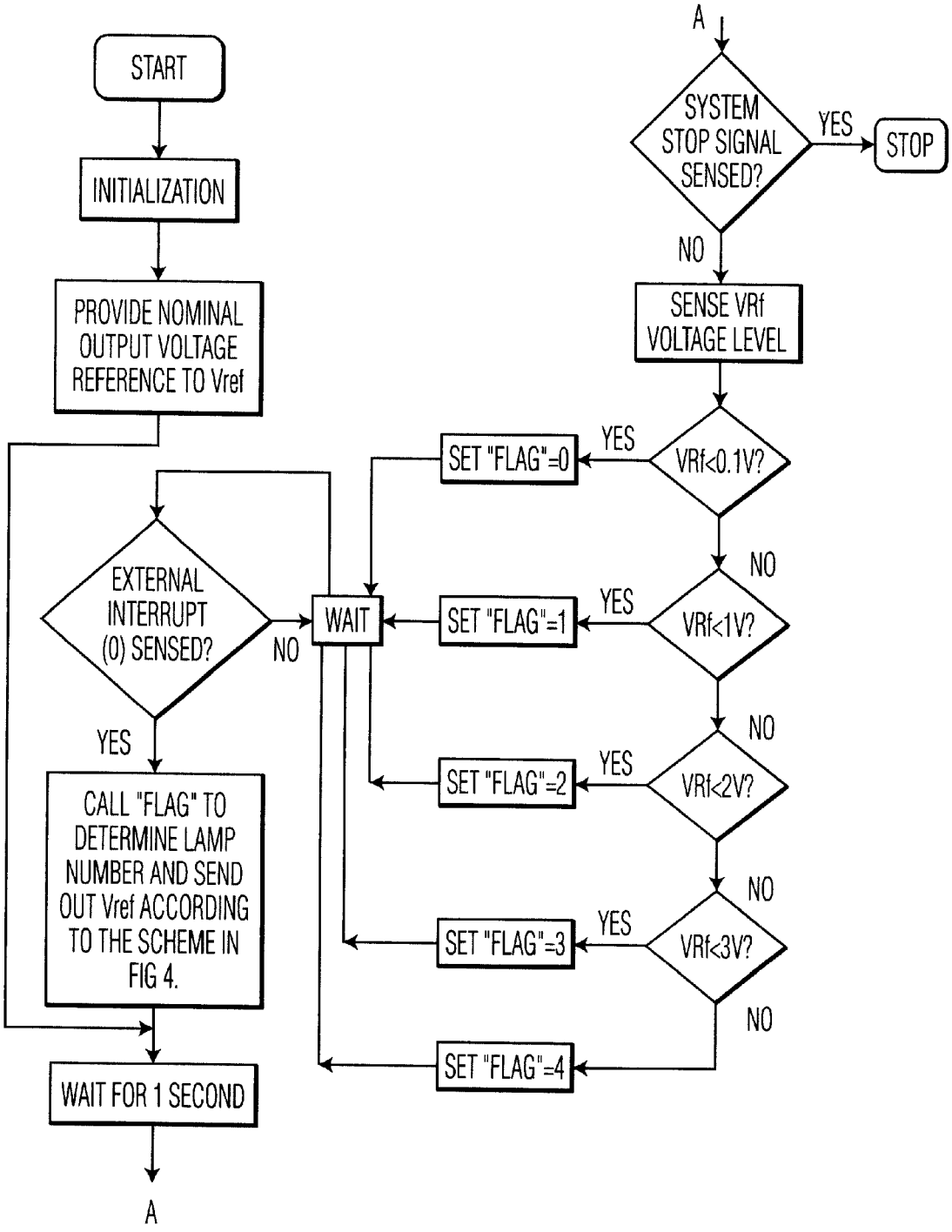
FIG. 5 is a flow chart of the control algorithm present in the microcontroller shown in FIG. 3.

FIG. 3 shows one preferred embodiment of the control circuit 19 which is based on the use of a known microcontroller, i.e. the Philips 87LPC767. The attached Appendix A shows and functionally outlines the pin connections of the microcontroller 31 of FIG. 3. FIG. 5 of the drawings shows a flow chart of the control algorithm for the microcontroller. The voltage, VRf, which is received from the photo-sensitive transistor 15 (see FIG. 2) and is proportional to the number of operating discharge lamps, is applied to pin 17 of the IC 31 which internally converts this voltage into its corresponding digital value via an A/D conversion.

At the same time, the signal voltage, VRf, is applied to the input of the edge detector circuit 33. In one embodiment of the invention, which will be explained with reference to the waveforms in FIG. 4A, only the positive going edges of the voltage, VRf, are detected and responded to. The digital output voltage Vref at terminal 1 of the IC 31 goes through a digital to analog conversion in D/A converter 32 before it is outputted at terminal 21 to the circuit 22 (FIG. 2).

In the case of a 4-lamp fixture employing fluorescent TL lamps of the type F32T8/TL735, the reliable ignition voltage is about 550 volts (rms). In order to limit the output voltage to a safe value and one consistent with the IEC 928 regulation mentioned above, we chose a value of the steady state operating lamp voltage of 450 V, which is below the IEC safety requirement of 495 V (rms). The circuit of FIG. 2 will regulate the steady state output voltage at 450 volts for all possible lamp combinations, i.e. for 0, 1, 2, 3 or 4 operating lamps in the 4-lamp fixture.

Figure 4:
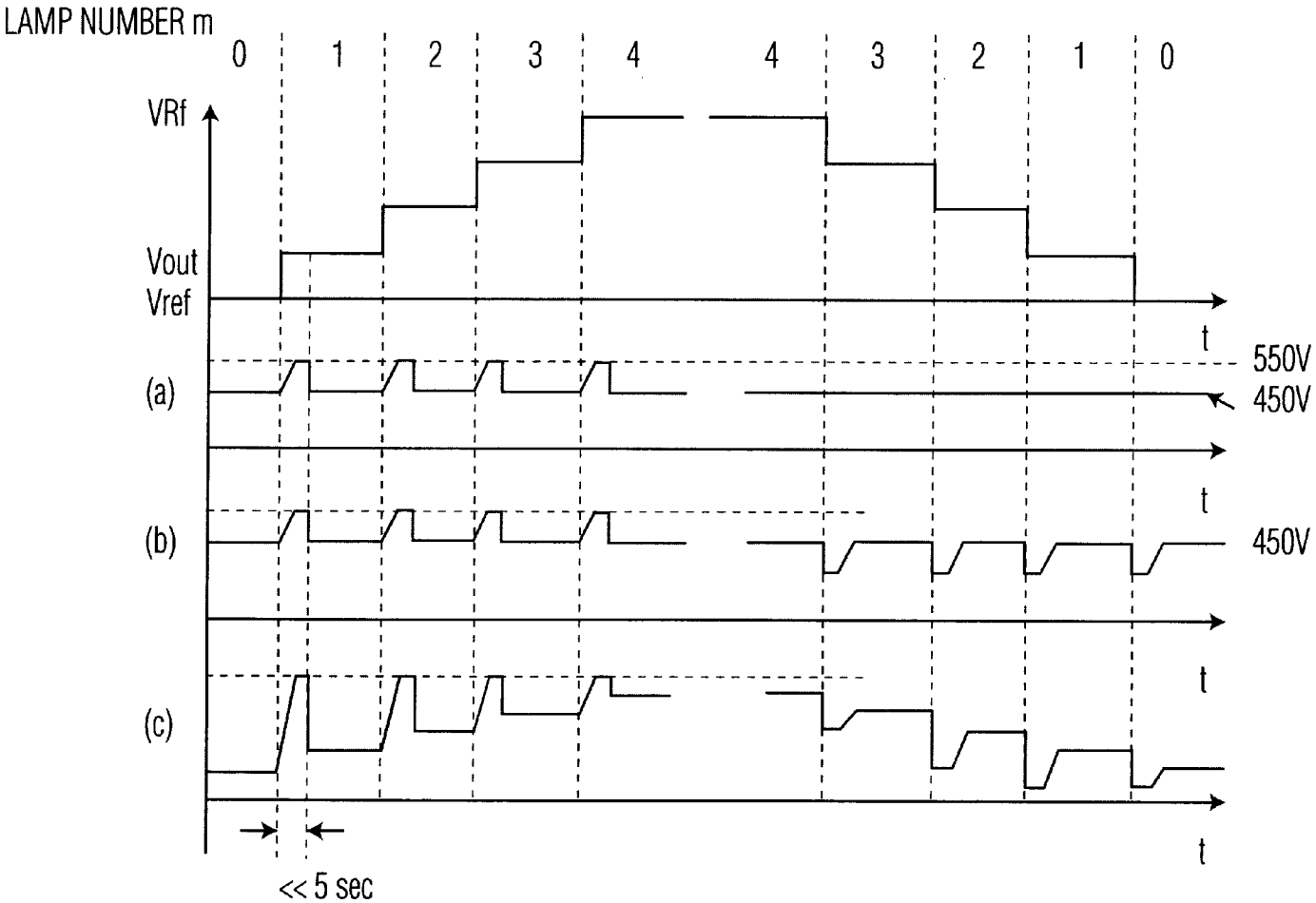
FIG. 4 is a waveform diagram of voltage vs. time which is useful in explaining the operation of the invention.

As shown in FIG. 4, each time a lamp is added to the circuit, the voltage, VRf, supplied by the photo-transistor 11,15 (FIG.2) rises to a new voltage level. As a result, the edge detector 33 responds to the positive going edge of this voltage and sends a signal to terminal 9 of the microcontroller 31. The microcontroller then follows the control algorithm shown in FIG. 5.

More particularly, after an initialization procedure in which Vref is set to a nominal voltage value and a wait period of one second, assuming there is no system stop signal sensed, the voltage, VRf, is sensed and the circuit output voltage is regulated in a closed loop. Assuming there is one operating lamp present in the circuit of FIG. 2 and a second lamp is added, testing for VRf<0.1 V will give a No indication, since this test will only provide a Yes indication for zero lamps in the circuit.

Similarly, the next test, corresponding to one lamp in the circuit, is VRf<1 V also produces a No indication. The next test, is VRf<2 V, now produces a Yes indication, so a flag is set corresponding to two lamps in the circuit of FIG. 2. After a short wait period it is determined that there are now two lamps and a voltage, Vref, is sent out via pin 1 of IC 31 and the D/A converter 32 to terminal 21, which in turn is applied as a control input to op-amp 22 in FIG. 2. The voltage controlled oscillator 27 of FIG. 2 responds so as to change its frequency, which in turn changes the drive to switching transistors Q2 and Q3 via the transistor driver circuit 30. As a result the lamp output voltage at terminal 14 (FIG. 2) quickly ramps up to the ignition voltage of 550 volts, causing the second lamp now added to the circuit to ignite.

The output voltage is maintained at the lamp ignition voltage (550 V) for a short time, whereupon the closed loop circuit including diode 23, op-amp 22, VCO 27, etc. (FIG. 2) returns the output voltage at terminal 14 to its steady state operating voltage of 450 V. This ignition procedure occurs in a time period very much shorter than 5 seconds, usually about 100 ms.

As can be seen from the right hand side of FIG. 4*a*, when a discharge lamp is removed from the circuit, the edge detector 33 does not respond to the negative going edge of the VRf voltage waveform, and so the lamp output voltage remains constant at the normal stable operating voltage of 450 V since the IC 31 is not triggered into operation. However, as shown by the waveform of FIG. 4*b*, it is also possible to provide an edge detector that responds to both positive and negative going edges of the VRf waveform, in which case each time a lamp is removed from the fixture, or becomes inoperative, the output voltage is temporarily reduced to a voltage level below the normal steady state operating voltage (e.g. 450v) of the discharge lamps. This type of operation will result in an apparatus with a faster response time.

The operation of the invention can be briefly summarized as follows. A simple filament current sensing circuit is used to detect the number of operating lamps and changes in the number of lamps. Then, the output voltage is adjusted accordingly through proper voltage reference generation and the feedback loop mentioned above.

In FIG. 2, the number operating lamps is identified via the total filament current sensing circuitry and the relation between the voltage VRf and the number of operating lamps is shown in FIG. 4. In FIG. 2, the block reference number I is a reference voltage generator with an input VRf and an output Vref. A typical relation between the generated reference voltage and the sensed total filament lamp current (re-scaled to VRf) is shown in FIG. 4(*a*). The block II is a voltage controlled oscillator (VCO) with an input from the error amplifier 22. The block III is a phase detector and control logic. The block IV is a half-bridge driver circuit.

In the normal operating condition, Vref is set to a constant value such that the regulated output voltage Vo is about 450 V (rms), as shown in FIG. 4(*a*). When a discharge lamp is inserted into the fixture, there is a jump in the total filament current which is sensed via the opto-coupler S and the resistor $R_f$ as shown in FIG. 2. According to the control rule set in FIG. 4(*a*), the block I generates a short higher voltage reference such that the output voltage is increased momentarily to 550 V (rms) for lamp ignition. The time duration of this higher voltage is much less than 5 seconds. After the lamp ignition, the output voltage is regulated back to the nominal 450 V (rms) following a corresponding decrease in the reference voltage Vref. In the case where one lamp is removed from the fixture, the reference voltage could stay unchanged, as in FIG. 4(*a*). In a second preferred embodiment, the reference voltage Vref could be designed to be momentarily reduced as shown in FIG. 4(*b*) such that the circuit will have a faster output voltage regulation during the removal of a discharge lamp from the fixture.

The lamp current in the electronic ballast apparatus of FIG. 2 can be expressed as follows:

$$I_{lp} = \frac{V_0}{\sqrt{R_{lp}^2 + \left(\frac{1}{\omega C_{lp}}\right)^2}} \tag{1}$$

In this equation, Vo is the output (lamp) voltage, $R_{lp}$ is the lamp impedance, ω is the circuit operating frequency and $C_{lp}$ is the capacitance of the series ballast capacitor of a discharge lamp.

In the case of resonant circuit operation, the operating frequency has to be adjusted in a manner so as to maintain a constant output voltage Vo for different numbers of operating lamps. As a result, the lamp current is different for different operating frequencies as is indicated in the relationship (1) set out above. Quantitatively, it could be shown that the relative frequency spread range is approximately equal to the relative lamp current spread range. For example, if the relative frequency spread range is 40% between one lamp and four lamps, the relative lamp current spread range is about 40% as well.

In some circuit applications, it is important to prevent lamp current overdrive. It is then possible to further modify the present invention as shown by the waveforms in FIG. 4(*c*) to provide a reference voltage generation scheme which will prevent lamp current overdrive. In the embodiment of the invention described by FIG. 4(*c*), the steady state lamp operating voltage is not the same for the different possible combinations of operating lamps (i.e. 1 through 4 lamps in the present example). Instead, according to the number of operating lamps (1 to 4), which therefore require different respective operating frequencies for the circuit, the steady state operating voltage is adjusted in a manner such that each lamp current is almost the same for the different operating frequencies. The governing relationship again is equation (1) shown above.

As shown in FIG. 4(*c*) each time a discharge lamp is added to the circuit, the output voltage rises to the lamp ignition voltage, and then is returned to a steady state operating voltage that is higher than the previous steady state operating voltage by an amount sufficient to maintain the lamp current in each lamp approximately the same as it was prior to the addition of the lamp. In the case of the removal of a lamp, or its becoming inoperative, the steady state operating voltage is again readjusted to a new level such as to maintain the lamp current approximately constant in the remaining operating lamps. This is accomplished by a readjustment of the operating frequency via the VCO 27. The steady state operating voltages for each level of the left-hand waveforms (increasing number of lamps) is the same as those for the right hand waveforms (decreasing number of lamps). As before, the different operating voltage levels is achieved by sensing the number of operating discharge lamps by detecting the level of total lamp filament currents and adjustment of the frequency of the VCO 27 accordingly in the circuit of FIG. 2.

A preferred embodiment of the apparatus made up of the devices 22, 27, 28 and 30 of FIG. 2 is based upon a multi-pin integrated circuit UBA2010, a product of Philips Corporation, and which is described in detail in U.S. Pat. No. 5,696,431 by D. J. Giannopoulos et al, and which is hereby incorporated by reference into the present U.S. patent application. In this integrated circuit embodiment, the gate (control) electrodes of the switching power MOSFETs Q2 and Q3 are connected to the G1 (pin 7) and G2 (pin 10) terminals, respectively, of the IC UBA2010. The junction point 10 between the field effect transistors Q2 and Q3 is connected to the S1 (pin 6) terminal of the IC, and output terminal 14 in FIG. 2 is connected via a resistive voltage divider to terminals Li1, Li2, VL and GND of the IC, i.e. pins 15, 16, 2 and 9, respectively. The DIM (pin 4) terminal of the IC is connected to the Vref input terminal (from terminal 21, FIG. 2, of the control circuit 19). The right side of sensing resistor 9 (FIG. 2) is connected to the RIND (pin 14) terminal of the IC, UBA2010. Pin 1 (CRECT) of the IC is connected to ground via a parallel RC circuit.

Pins 2 and 3 of the IC are connected to ground via respective capacitors, as is pin 13 (Cf). Pin 12 (Rref) is connected to ground via a resistor. The operation of control IC UBA2010 is described in U.S. Pat. No. 5,696,431, especially in connection with FIG. 3 thereof, and essentially performs the functions outlined above for the circuits 22, 27, 28 and 30 in connection with FIG. 2 of the drawing. More particularly, the lamp output voltage at terminal 14 and the Vref voltage from terminal 21 of the control circuit 19 are inputted to the IC and processed therein so as to control the switching frequency of switching transistors Q2 and Q3 in a manner so as to maintain the lamp output voltage at terminal 14 constant (i.e. at 450 V in the present example). In addition, the IC will momentarily adjust the switching frequency of transistors Q2 and Q3 each time a lamp is added to the output circuit so as to momentarily raise the output voltage at terminal 14 above the lamp ignition voltage, i.e. to a voltage level of 550 V in the given example.

In accordance with the invention described above, it is now possible to simply and reliably regulate the output voltage in a multiple discharge lamp output circuit of an electronic ballast apparatus so that both independent lamp operation and electric shock safety requirements are satisfied in a relatively simple and inexpensive manner. In addition, with a little modification, as discussed, for example, with reference to FIG. 4(*c*), it is also possible to provide almost constant lamp current for each possible combination of operative and inoperative (or missing) discharge lamps in the ballast output circuit. As a result, lamp life is extended and the ballast efficacy is improved even under partial load conditions.

Although the invention has been described above in connection with certain preferred embodiments thereof, it will be apparent from the above description that various changes and modifications can be made in the method and construction set forth without departing from the spirit and scope of the invention. Therefore, all matter contained in the above description and shown in the accompanying drawings shall be interpreted as illustrative and not in a limiting sense. Accordingly, it is intended that the appended claims cover all such embodiments as fall within the spirit and scope of the invention disclosed.

What is claimed is:

1. A method of energizing a plurality of discharge lamps which comprises:

supplying a high frequency alternating voltage to said plurality of discharge lamps, detecting the level of total filament current flow through the discharge lamps, deriving a reference voltage determined by the level of total filament current flow, deriving a frequency control parameter as a function of a comparison of the reference voltage and an electric parameter related to the discharge lamps, and adjusting the frequency of the high frequency alternating voltage on the basis of said frequency control parameter so as to maintain a given level of lamp output voltage irrespective of the number of operating discharge lamps.

2. The discharge lamp energizing method as claimed in claim 1 wherein said electric parameter is the lamp output voltage.

3. The discharge lamp energizing method as claimed in claim 2 wherein the plurality of discharge lamps are connected in parallel and said high frequency alternating voltage is supplied by a high frequency DC/AC inverter coupled to the discharge lamps via a resonant circuit.

4. The discharge lamp energizing method as claimed in claim 1 which further comprises:

at an instant when a discharge lamp is added to the plurality of discharge lamps, thereby increasing the number of discharge lamps supplied by the high frequency alternating voltage, momentarily increasing the high frequency alternating voltage to a voltage level above the ignition voltage of the added discharge lamp.

5. The discharge lamp energizing method as claimed in claim 1 wherein the operating voltage of the discharge lamps is lower than the lamp ignition voltage, and the frequency of the high frequency alternating voltage is adjusted so as to supply the discharge lamps with a voltage equal to the lamp operating voltage.

6. The discharge lamp energizing method as claimed in claim 1 which further comprises;

adjusting the level of lamp voltage in a manner so as to maintain the level of current flow in each discharge lamp relatively constant irrespective of the number of operating discharge lamps.

7. An apparatus for energizing a plurality of discharge lamps, the apparatus comprising:

first and second input terminals for connection to a source of supply voltage for the apparatus, first and second output terminals for connection to an output circuit having connection terminals for connection to a plurality of discharge lamps, means including at least a first switching transistor coupled to said first and second input terminals for generating a high frequency alternating output voltage, an LC resonant circuit coupling the alternating voltage generating means to said first and second output terminals, means for detecting the level of total lamp filament current flow through one or more connected discharge lamps and deriving a control signal corresponding thereto, means controlled at least in part by said control signal for deriving a reference voltage determined thereby, means controlled by said high frequency alternating output voltage and said reference voltage for deriving a frequency control signal on the basis of the number of operating discharge lamps connected to the output circuit, and means controlled by said frequency control signal for controlling the switching frequency of said first switching transistor so as to maintain the output voltage at the output terminals at the stable operating voltage of the discharge lamps irrespective of the number of operating discharge lamps connected to the output circuit.

8. A discharge lamp energizing apparatus as claimed in claim 7 wherein the output circuit is adapted to connect the plurality of discharge lamps in parallel and said high frequency alternating voltage generating means comprises a DC/AC inverter coupled to said input terminals and via the LC resonant circuit to said output terminals.

9. A discharge lamp energizing apparatus as claimed in claim 7 wherein said reference voltage deriving means is adapted to momentarily increase the voltage level of said reference voltage in response to an increase in said control signal at the moment when an additional discharge lamp is connected to the output circuit, and said frequency control signal deriving means responds to said momentary increase in the voltage level of the reference voltage to adjust the frequency control signal in a manner such that the switching frequency of the first switching transistor is momentarily changed to a value which increases the output voltage of the high frequency alternating voltage generating means to a level which produces at the output terminals a voltage of at least the ignition voltage level of said additional discharge lamps.

10. A discharge lamp energizing apparatus as claimed in claim 7 wherein all of said plurality of discharge lamps have the same ignition voltage and the same operating voltage.

11. A discharge lamp energizing apparatus as claimed in claim 7 wherein said reference voltage deriving means comprise a microcontroller having a first input for receiving said control signal, and an edge detector that receives said control signal and responds only to edges of one polarity thereof, and means coupling an output of the edge detector to a second input of the microcontroller which momentarily changes the output level of the reference voltage only for edges of said one polarity of the control signal.

12. A discharge lamp energizing apparatus as claimed in claim 9 wherein said reference voltage deriving means comprise a microcontroller having a first input for receiving said control signal, and an edge detector that receives said control signal and responds only to edges of one polarity thereof, and means coupling an output of the edge detector to a second input of the microcontroller which momentarily changes the output level of the reference voltage only for edges of said one polarity of the control signal.

13. A discharge lamp energizing apparatus as claimed in claim 11 wherein said frequency control signal deriving means and said switching frequency controlling means together comprise a control IC that receives as inputs the reference voltage from an output of the microcontroller, a voltage determined by the output voltage at the output terminals, a signal voltage determined at least in part by the total lamp current, a voltage at the input of the resonant circuit, and at least one output coupled to a control electrode of the first switching transistor.

14. A discharge lamp energizing apparatus as claimed in claim 7 wherein said first and second input terminals are coupled to output terminals of a boost converter that provides power factor correction and comprises;

an inductor and a diode coupled in series to the first input terminal, a transistor power switch coupled to a junction point between the inductor and diode, a storage capacitor coupled across the output terminals of the boost converter, and a control circuit controlled by the voltage across the storage capacitor and by current flow through the transistor power switch and having an output coupled to a control electrode of the transistor power switch so as to control the switching thereof.

15. A discharge lamp energizing apparatus as claimed in claim 7 wherein said high frequency alternating output voltage generating means comprise a second switching transistor connected in series circuit with the first switching transistor across said first and second input terminals and with a circuit point therebetween coupled to an input of the LC resonant circuit, the LC resonant circuit includes a capacitor coupled across the first and second output terminals so as to be in parallel with such discharge lamps as are connected to the output circuit, and wherein said means for deriving the control signal comprises an opto-coupler having its input coupled to receive lamp filament current and an output that supplies the control signal to the reference voltage deriving means.

16. A discharge lamp energizing apparatus as claimed in claim 9 wherein said reference voltage deriving means is adapted to momentarily decrease the voltage level of said reference voltage in response to a decrease in said control signal at the moment when a discharge lamp is removed from the output circuit, and said frequency control signal deriving means responds to said momentary decrease in the voltage level of the reference voltage so as to adjust the frequency control signal in a manner such that the switching frequency of the first switching transistor is momentarily changed to a value which decreases the output voltage of the high frequency alternating voltage generating means.

17. A discharge lamp energizing apparatus as claimed in claim 9 wherein, in response to said reference voltage, said frequency control signal deriving means further adjusts the frequency control signal to a frequency value that is dependent on the number of operating discharge lamps in the output circuit whereby the switching frequency controlling means controls the switching frequency of the first transistor so as to adjust the output voltage to a different stable operating voltage determined by said number of operating discharge lamps and in a manner so as to maintain the lamp current for each lamp approximately constant irrespective of the number of operating discharge lamps connected to the output circuit.

18. An apparatus for energizing a plurality of discharge lamps, the apparatus comprising:

a DC/AC converter circuit including a switching transistor, an output circuit coupled to an output of the DC/AC converter circuit and including connection terminals for connecting a plurality of discharge lamps in parallel in the output circuit, means for detecting the total lamp current and deriving a control signal proportional thereto, means controlled by said control signal for deriving a reference voltage determined thereby, means controlled by the DC/AC converter circuit output voltage and said reference voltage for deriving a frequency control signal determined by the number of operating discharge lamps connected to the output circuit, and means controlled by said frequency control signal for controlling the switching frequency of said switching transistor so as to maintain the output voltage of the DC/AC converter circuit at the stable operating voltage of the discharge lamps irrespective of the number of operating discharge lamps connected to the output circuit.

19. A discharge lamp energizing apparatus as claimed in claim 18 wherein said frequency control signal is automatically adjusted to a different respective frequency determined by the number of operating discharge lamps connected to the output circuit at any moment in time thereby to maintain a constant operating voltage at the output of the DC/AC converter circuit so as to operate the discharge lamps at their rated lamp operating voltage during stable operation thereof.

* * * * *